US009760058B2

(12) United States Patent
Hashimoto et al.

(10) Patent No.: US 9,760,058 B2
(45) Date of Patent: Sep. 12, 2017

(54) IMAGE FORMING APPARATUS PROVIDING STABLE ENGAGEMENT BETWEEN GEARS UPON ATTACHMENT OF DRUM UNIT TO HOUSING

(71) Applicant: Brother Kogyo Kabushiki Kaisha, Nagoya-shi, Aichi-ken (JP)

(72) Inventors: Junichi Hashimoto, Toyohashi (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,112

(22) Filed: Mar. 31, 2016

(65) Prior Publication Data

US 2016/0291524 A1 Oct. 6, 2016

(30) Foreign Application Priority Data

Apr. 3, 2015 (JP) ..... 2015-076466

(51) Int. Cl.
*G03G 21/16* (2006.01)
*G03G 21/10* (2006.01)

(52) U.S. Cl.
CPC ..... *G03G 21/1647* (2013.01); *G03G 21/105* (2013.01); *G03G 2215/0141* (2013.01); *G03G 2221/1657* (2013.01); *G03G 2221/1684* (2013.01)

(58) Field of Classification Search
CPC ..... G03G 21/1647; G03G 21/105; G03G 2221/1657; G03G 2221/1684; G03G 21/10–21/12
See application file for complete search history.

(56) References Cited

U.S. PATENT DOCUMENTS 8,380,103 B2 2/2013 Souda
8,634,743 B2 * 1/2014 Akaike ..... G03G 21/12 399/110
9,134,684 B2 * 9/2015 Sato ..... G03G 21/0005
2010/0119271 A1 * 5/2010 Akaike ..... G03G 21/12 399/358
2010/0329757 A1 12/2010 Souda
2011/0044743 A1 * 2/2011 Yuasa ..... G03G 21/12 399/358
2016/0291527 A1 * 10/2016 Hashimoto ..... G03G 21/105

FOREIGN PATENT DOCUMENTS

JP 2011-013268 A 1/2011

* cited by examiner

*Primary Examiner* — David M Gray
*Assistant Examiner* — Carla Therrien
(74) *Attorney, Agent, or Firm* — Banner & Witcoff, Ltd.

(57) ABSTRACT

An image forming apparatus includes a housing and a drum unit. The drum unit is out of the housing at a first position, moved in a first direction from the first position to a second position in the housing, and then to a third position away from the first position. The drum unit includes: a photosensitive drum; a cleaning unit for toner; a conveying tube extending in the first direction; a conveying member in the conveying tube and rotatable about a first axis extending in the first direction; and a first gear fixed to the conveying member and rotatable about the first axis. The housing has a second gear rotatable about a second axis extending in the first direction. The first gear is separated from the second gear at the second position, and engaged with the second gear at the third position. The first axis and the second axis overlap in the third position.

12 Claims, 11 Drawing Sheets

IMAGE FORMING APPARATUS PROVIDING STABLE ENGAGEMENT BETWEEN GEARS UPON ATTACHMENT OF DRUM UNIT TO HOUSING

CROSS REFERENCE TO RELATED APPLICATION

This application claims priority from Japanese Patent Application No. 2015-076466 filed Apr. 3, 2015. The entire content of the priority application is incorporated herein by reference.

TECHNICAL FIELD

The present disclosure relates to an electro-photographic type image forming apparatus.

BACKGROUND

As an electro-photographic type image forming apparatus, there is known a printer including a housing and a photosensitive unit supporting a photosensitive drum that is detachably attached to the housing.

Japanese Patent Application Publication No. 2011-13268 discloses a printer, in which a photosensitive unit that has been detached from a frame member of the housing and positioned at a detached position is attached to the frame member as a result of insertion of the photosensitive unit in a diagonally downward direction after the photosensitive unit is inserted into the frame member in a horizontal direction.

SUMMARY

In the printer described above, toner may be deposited on a surface of the photosensitive drum during image forming operation. Therefore, provision of a cleaning unit is considered to remove toner from the photosensitive drum. In the latter case, a conveyer member needs to be disposed at the photosensitive unit in order to convey the toner removed by the cleaning unit. Such conveyer member may be driven upon power transmission through a gear disposed in the housing.

However, according to the disclosed printer, since the photosensitive unit is detachable from and attachable to the housing, the conveyer member must be engaged with the gear when the photosensitive unit is attached to the housing, and the conveyer member must be disengaged from the gear when the photosensitive unit is detached from the housing. Accordingly, a complicated structure is required in the printer.

In particular, since the photosensitive unit is inserted in the housing diagonally downward, stabilized engagement between the conveyer member and the gear may not be attained when the photosensitive unit is attached to the housing.

In view of the foregoing, it is an object of the disclosure to provide an image forming apparatus having a simple construction and capable of providing stable meshing engagement between a first gear and a second gear when a drum unit provided with a cleaning unit and a conveyer member is positioned at a third position.

In order to attain the above and other objects, according to one aspect, the disclosure provides an image forming apparatus including a housing and a drum unit configured to move to a first position, a second position, and a third position, the drum unit being positioned outside the housing at the first position, the drum unit being configured to move in a first direction from the first position into the housing at the second position, and the drum unit being configured to move from the second position in a direction away from the first position to the third position at which the drum unit is inclined downward with respect to the first direction. The drum unit includes: a photosensitive drum having a surface; a cleaning unit configured to remove residual toner deposited on the surface; a conveying tube extending in the first direction and formed with a discharge opening through which the toner is discharged; a conveying member disposed in the conveying tube and configured to be rotated about a first axis extending in the first direction; and a first gear fixed to the conveying member and configured to be rotated about the first axis. A second gear is provided at the housing and configured to be rotated about a second axis extending in the first direction. The first gear is disengaged from the second gear at the second position of the drum unit, and engaged with the second gear at the third position of the drum unit, the first axis being positioned upward of the second axis in the third position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

1. Overall Structure of Image Forming Apparatus

Figure 1:
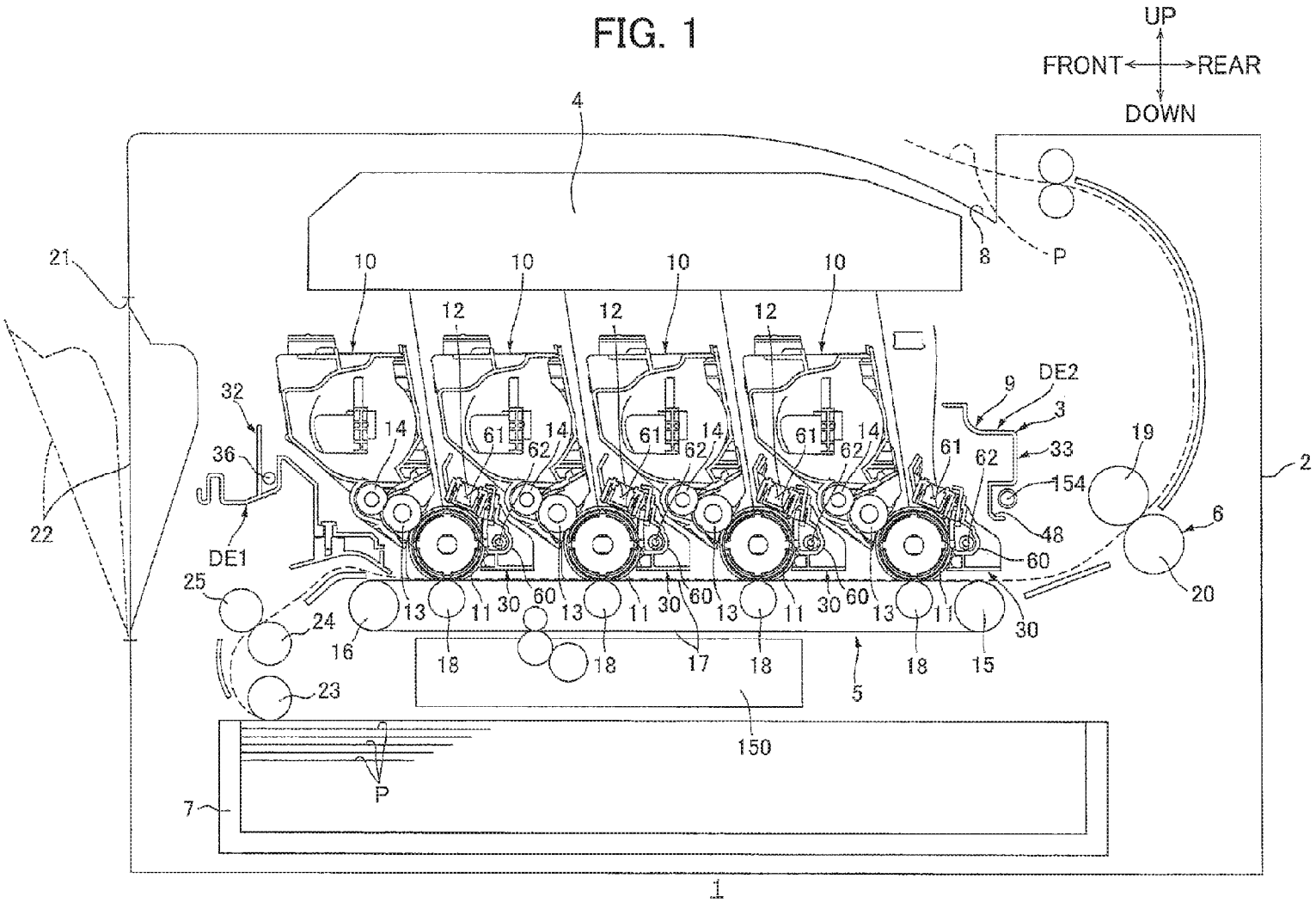
FIG. 1 is a center cross-sectional view of an image forming apparatus according to a first embodiment.

As illustrated in FIG. 1, an image forming apparatus 1 is a horizontal direct tandem-type color laser printer.

The image forming apparatus 1 includes a housing 2 formed with an opening 21, a process unit 3, a scanner unit 4, a belt unit 5, and a fixing unit 6.

The housing 2 is formed in a general box-like shape. The housing 2 includes a front cover 22 as an example of a cover, a sheet supply tray 7, a sheet supply roller 23, a first registration roller 24, a second registration roller 25, and a discharge tray 8.

The opening 21 is formed in a front side of the housing 2. The opening 21 provides communication between an interior and exterior of the housing 2 and allows the process unit 3 to pass therethrough.

The front cover 22 is provided on the front side of the housing 2. The front cover 22 has generally flat plate shape. The front cover 22 extends vertically when in its closed position. The front cover 22 is supported to a front wall of the housing 2 and is capable of pivotally moving about its bottom end portion. The front cover 22 is adapted to be moved to an open position opening the opening 21 and to a closed position closing the opening 21.

The sheet supply tray 7 is disposed at a bottom section of the housing 2. The sheet supply tray 7 is adapted to accommodate sheets P.

The sheet supply roller 23 is adapted to supply the sheet P on the sheet supply tray 7 to a position between the first registration roller 24 and the second registration roller 25. The first registration roller 24 is positioned above the sheet supply roller 23. The second registration roller 25 is in contact with a front upper end portion of the first registration roller 24. The first and second registration rollers 24, 25 are adapted to convey the sheet P at a prescribed timing by their rotation to a position between a photosensitive drum 11 and a belt 17 those described later.

The discharge tray 8 is disposed at a top wall of the housing 2. The discharge tray 8 is recessed downward from a top surface of the housing 2 in order to receive the sheets P.

Figure 6A:
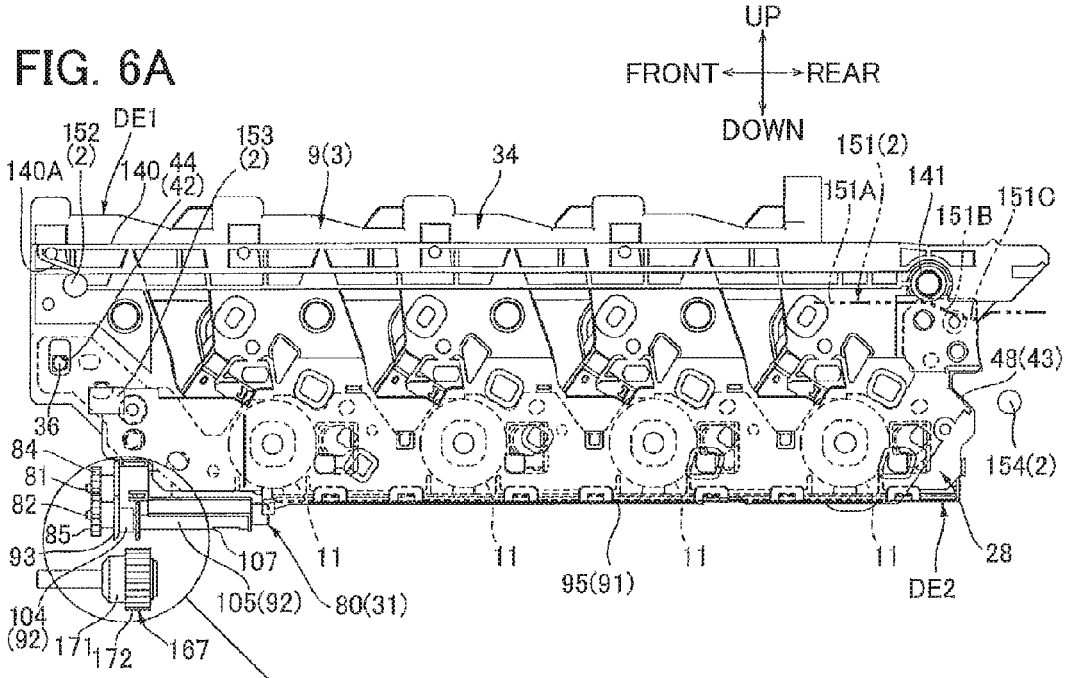
FIG. 6A is a view for description of attachment and detachment of the drum unit to and from the housing and showing a state where the drum unit is at a second position in the image forming apparatus according to the first embodiment.
Figure 8A:
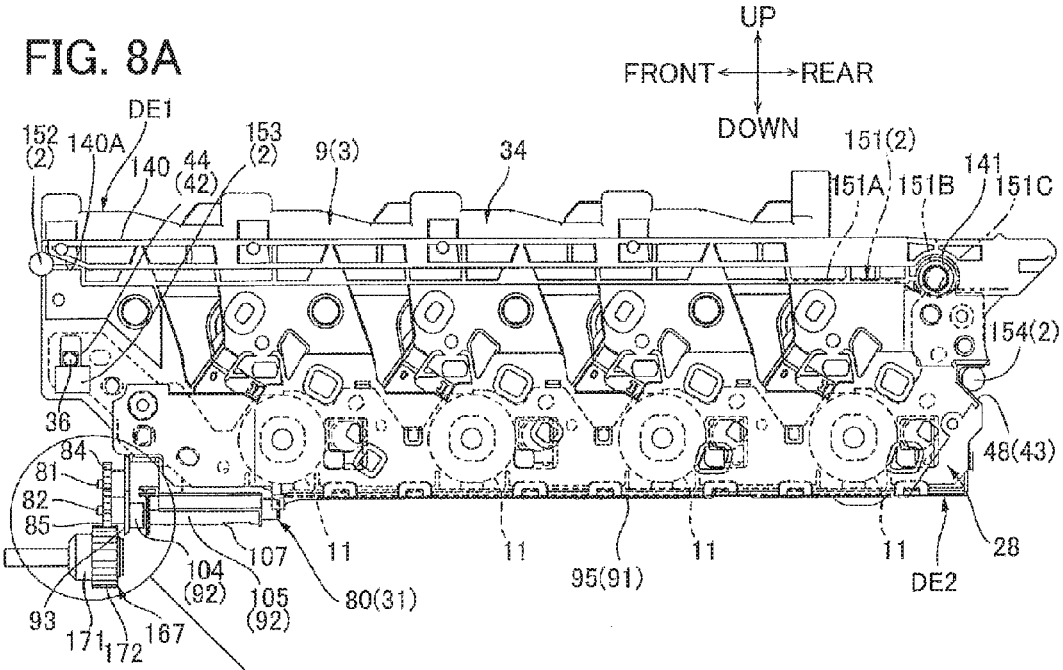
FIG. 8A is a view for description of attachment and detachment of the drum unit to and from the housing and showing a state where the drum unit is positioned at the third position in the image forming apparatus according to the first embodiment.
Figure 8B:
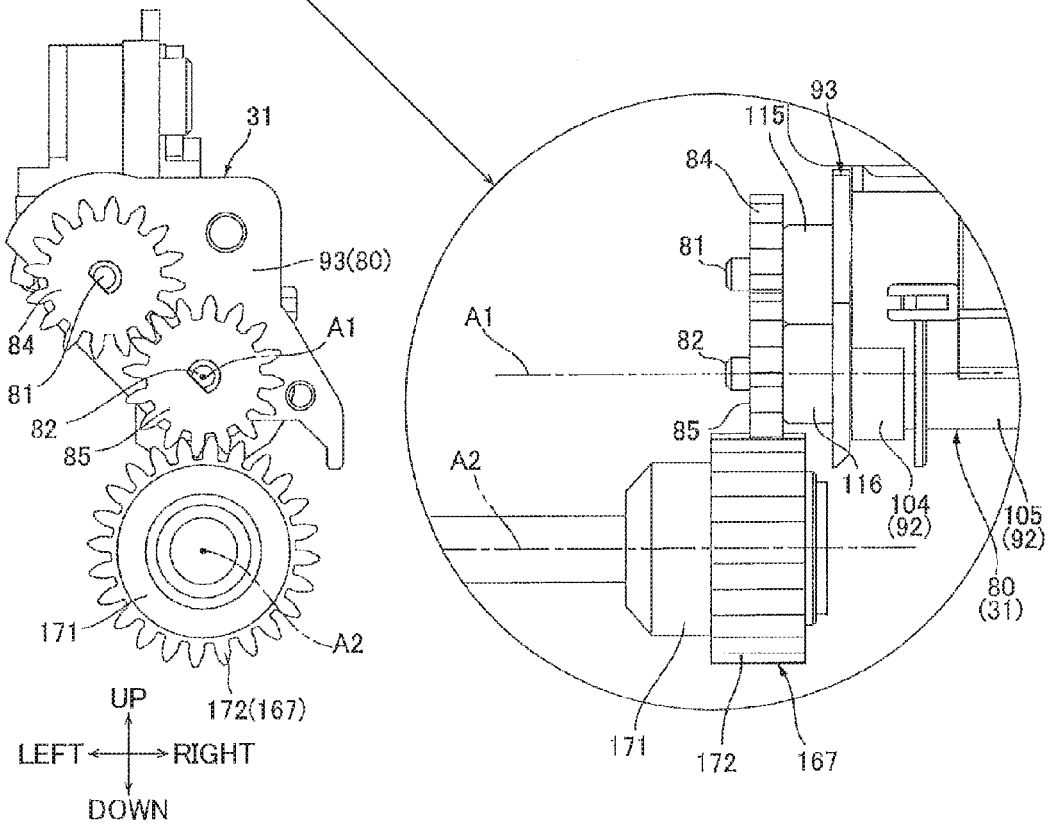
FIG. 8B is a front view illustrating positional relationship between the second conveyer gear and the transmission gear those illustrated in FIG. 8A.

The process unit 3 is disposed in an approximate center region of the housing 2. The process unit 3 is slidably movable between a first position and a second position in a frontward/rearward direction. In the first position the process unit 3 is positioned outside the housing 2, and in the second position the process unit is positioned inside the housing 2 as illustrated in FIG. 6A after passing through the opening 21. Further, the process unit 3 is movable rearward and downward from the second position to a third position where the process unit 3 approaches the belt unit 5 as illustrated in FIGS. 1 and 8A. The process unit 3 is also movable from the third position to the second position. The process unit 3 includes a drum unit 9 and a plurality of (four) developing cartridges 10 as illustrated in FIG. 1.

The drum unit 9 includes a plurality of (four) photosensitive drums 11 and a plurality of (four) scorotron chargers 12.

Each of the plurality of photosensitive drums 11 is rotatably supported in a lower end portion of the process unit 3. The plurality of photosensitive drums 11 respectively correspond to four colors, i.e., yellow, magenta, cyan, and black. The plurality of photosensitive drums 11 are arranged juxtaposed with each other and spaced at intervals in order of yellow, magenta, cyan, and black from the front side to the rear side of the housing 2. That is, the plurality of photosensitive drums 11 are arrayed in a front-rear direction. Each of the plurality of photosensitive drums 11 has a generally cylindrical shape with its axis oriented in a leftward/rightward direction.

The plurality of scorotron chargers 12 respectively correspond to the plurality of photosensitive drums 11, and are disposed diagonally above and rearward of the corresponding photosensitive drums 11 with a gap therebetween.

The plurality of developing cartridges 10 are identical to each other except for color of toner accommodated therein. The developing cartridges 10 respectively correspond to the plurality of photosensitive drums 11, and are disposed above the corresponding photosensitive drums 11. Each of the plurality of developing cartridges 10 includes a developing roller 13 and a supply roller 14.

The developing roller 13 is rotatably supported in a lower end portion of the corresponding developing cartridge 10 such that its outer circumferential surface is exposed outside at the rear side of the developing cartridge 10. The developing roller 13 is positioned to contact an upper front surface of the corresponding photosensitive drum 11.

The supply roller 14 is disposed diagonally above and forward of the corresponding developing roller 13. The supply roller 14 contacts an upper front surface of the corresponding developing roller 13.

The scanner unit 4 is disposed at an upper end portion of the housing 2. As indicated by solid lines of FIG. 1, the scanner unit 4 irradiates laser beams based on image data toward the photosensitive drums 11, exposing the photosensitive drums 11 to light.

The belt unit 5 is disposed below the process unit 3. The transfer unit 5 includes a drive roller 15, a follower roller 16, a belt 17, and a plurality of (four) transfer rollers 18.

The drive roller 15 constitutes a rear end portion of the belt unit 5.

The follower roller 16 constitutes a front end portion of the belt unit 5 at a position opposing and spaced apart from the drive roller 15.

The belt 17 is looped around the drive roller 15 and the follower roller 16 such that an upper portion thereof contacts all of the photosensitive drums 11 when the drum unit 9 is at the third position. The belt 17 moves in a circulating manner upon driving rotation of the drive roller 15 and a following rotation of the follower roller such that the upper portion of the belt 17 moves from the front side toward the rear side.

The plurality of transfer rollers 18 are respectively provided to correspond to the plurality of photosensitive drums 11, and are disposed below the corresponding photosensitive drums 11 with the upper portion of the belt 17 being nipped between each photosensitive drum 11 and each transfer rollers 18.

The fixing unit 6 is disposed rearward of the belt unit 5. The fixing unit 6 includes a heat roller 19, and a pressure roller 20 in contact with the heat roller 19.

When the image forming apparatus 1 starts an image forming operation, the scorotron chargers 12 applies a uniform charge to the surfaces of the corresponding photosensitive drums 11. Subsequently, the scanner unit 4 exposes the surfaces of the photosensitive drums 11 to light, forming electrostatic latent images based on image data on the surfaces of the photosensitive drums 11.

In the meantime, the supply rollers 14 supply toner from the corresponding developing cartridges 10 to the corresponding developing rollers 13. At this time, the toner is tribocharged with positive polarity between the developing rollers 13 and the corresponding supply rollers 14, and hence the charged toner is carried on the developing rollers 13.

Next, the developing rollers 13 supply the toner carried thereon to the electrostatic latent images formed on the surfaces of the corresponding photosensitive drums 11, producing toner images on the surfaces of the photosensitive drums 11.

The sheet P on the sheet supply tray 7 is conveyed frontward and upward by the rotations of the sheet supply roller 23, and the first and second registration rollers 24, 25, and is then turned in U-shaped manner rearward and upward, so that each one of the sheets P is supplied to a position between the photosensitive drum 11 for yellow color and the belt 17. Then, the sheet P on the belt 17 is conveyed rearward, so that toner images on the photosensitive drums 11 are transferred to the sheet P when the sheet P passes between each photosensitive drum 11 and each transfer roller 18.

Subsequently, the heat roller 19 and the pressure roller 20 apply heat and pressure to the sheet P as the sheet P passes therebetween. At this time, the toner image is thermally fixed onto the sheet P. Thereafter, the sheet P is discharged to the discharge tray 8.

2. Details of Drum Unit

Figure 2:
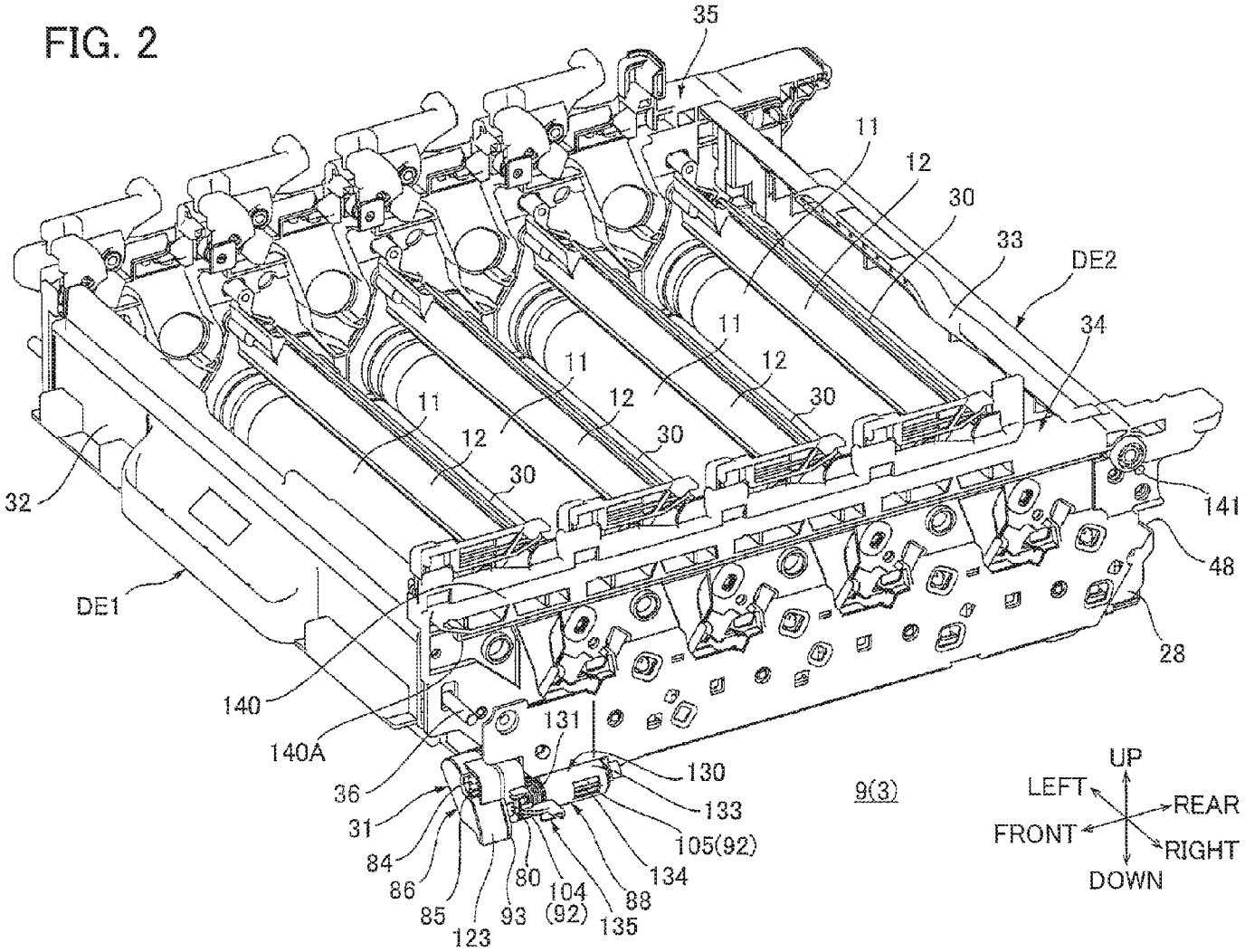
FIG. 2 is a perspective view of a drum unit provided in the image forming apparatus in FIG. 1 as viewed from an upper right side thereof.
Figure 4:
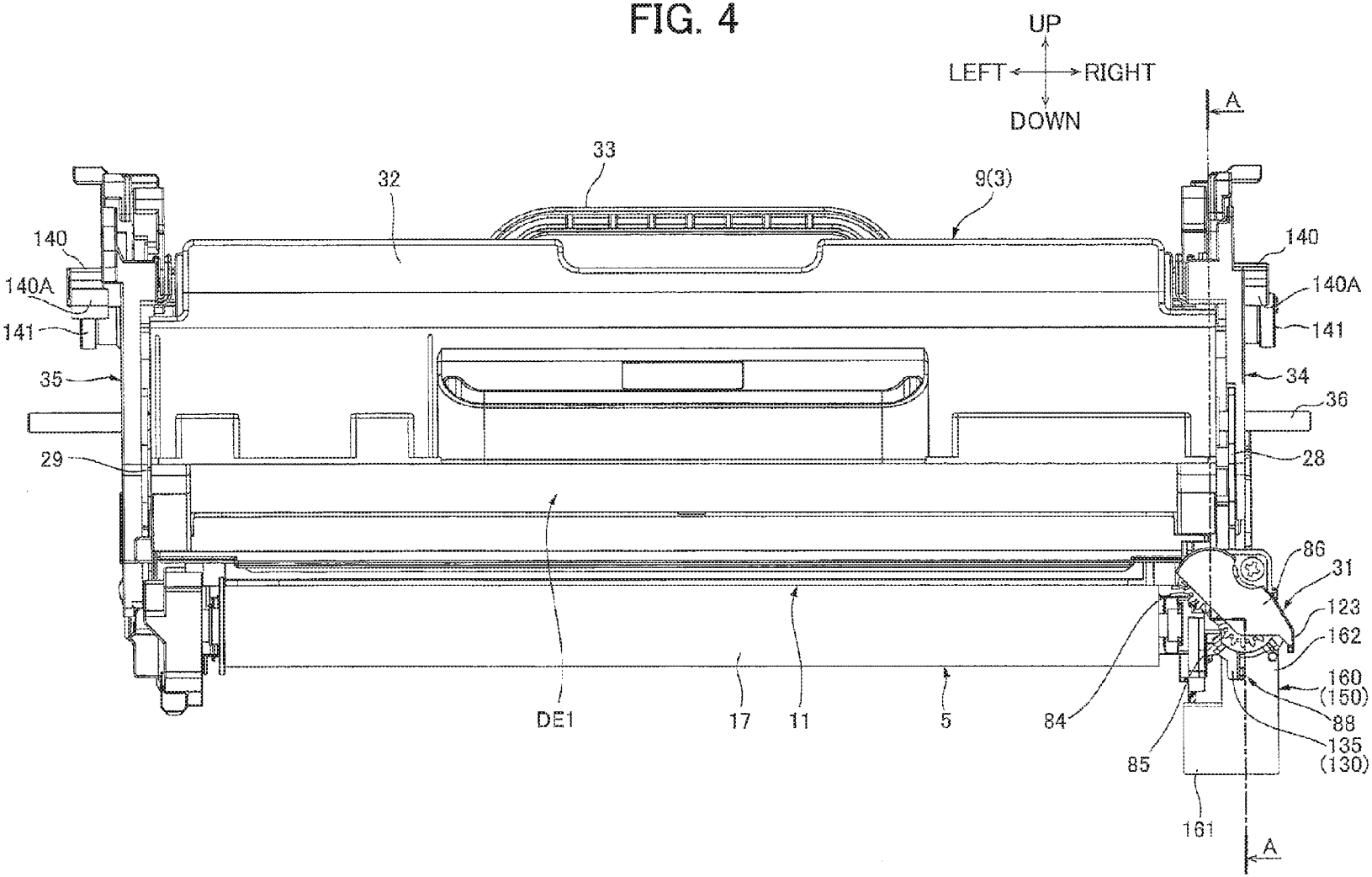
FIG. 4 is a front view of the drum unit and a belt unit in the image forming apparatus according to the first embodiment.

As illustrated in FIGS. 2 and 4, the drum unit 9 has a generally rectangular frame shape in a plan view. The drum unit 9 includes a first positioning plate 28, a second positioning plate 29, a plurality of (four) cleaning units 30, a conveying unit 31, a front plate 32, a rear plate 33, a first side plate 34, a second side plate 35 and a unit reference shaft 36.

(1) First Positioning Plate and Second Positioning Plate

As illustrated in FIG. 4, the first positioning plate 28 is disposed at a right end portion of the drum unit 9. As illustrated in FIG. 6A, the first positioning plate 28 is generally flat rectangular shaped in side view elongated in the frontward/rearward direction. The first positioning plate 28 includes a sloped portion 42 formed with a hole 44 through which the unit reference shaft 36 extends, and a bending portion 43 formed with a notched portion 48.

The sloped portion 42 is generally flat rectangular shaped in side view extending frontward and upward from a front end portion of the first positioning plate 28.

The hole 44 is positioned at a front upper end portion of the sloped portion 42, and is generally circular shaped in side view.

The bending portion 43 is generally flat rectangular shaped in side view extending upward from a rear end portion of the first positioning plate 28.

The notched portion 48 is positioned at a rear end portion of the bending portion 43. The notched portion 48 is notched frontward from a rear edge of the bending portion 43, so that the notched portion 48 is generally V-shaped in side view whose rear end portion is open.

As illustrated in FIG. 4, the second positioning plate 29 is positioned at a left end portion of the drum unit 9 and is spaced away leftward from the first positioning plate 28. The second positioning plate 29 has a shape generally identical to the shape of the first positioning plate 28, and therefore, further description to the second positioning plate 29 will be omitted.

The first positioning plate 28 and the second positioning plate 29 rotatably support right end portions and left end portions of the four photosensitive drums 11, respectively.

(2) Cleaning Unit

As illustrated in FIGS. 1 and 2, each of the cleaning units 30 is positioned rearward of each corresponding one of the photosensitive drum 11. The cleaning unit 30 is adapted to remove residual toner deposited on the surface of the photosensitive drum 11. As illustrated in FIG. 1, the cleaning unit 30 includes a frame 60, a blade 61, and a conveying member 62.

The frame 60 extends in the leftward/rightward direction, and has a hollow semi-cylindrical shape. The frame 60 has right end portion and a front end portion which are open, and has a left end portion which is closed.

The blade 61 is generally flat shaped extending in the leftward/rightward direction. The blade 61 has an upper end portion fixed to an upper end portion of the frame 60. The blade 61 has a lower end portion positioned frontward of the frame 60 and covering an upper half region of the opening of the front end portion of the frame 60. The lower end portion of the blade 61 is curved rearward and in contact with a rear end portion of the photosensitive drum 11.

The conveying member 62 is disposed in the frame 60. The conveying member 62 is an auger screw in the form of a right-handed screw and extends in the leftward/rightward direction. The conveying member 62 has a left end portion rotatably supported to a left wall of the frame 60.

(3) Conveying Unit

Figure 5:
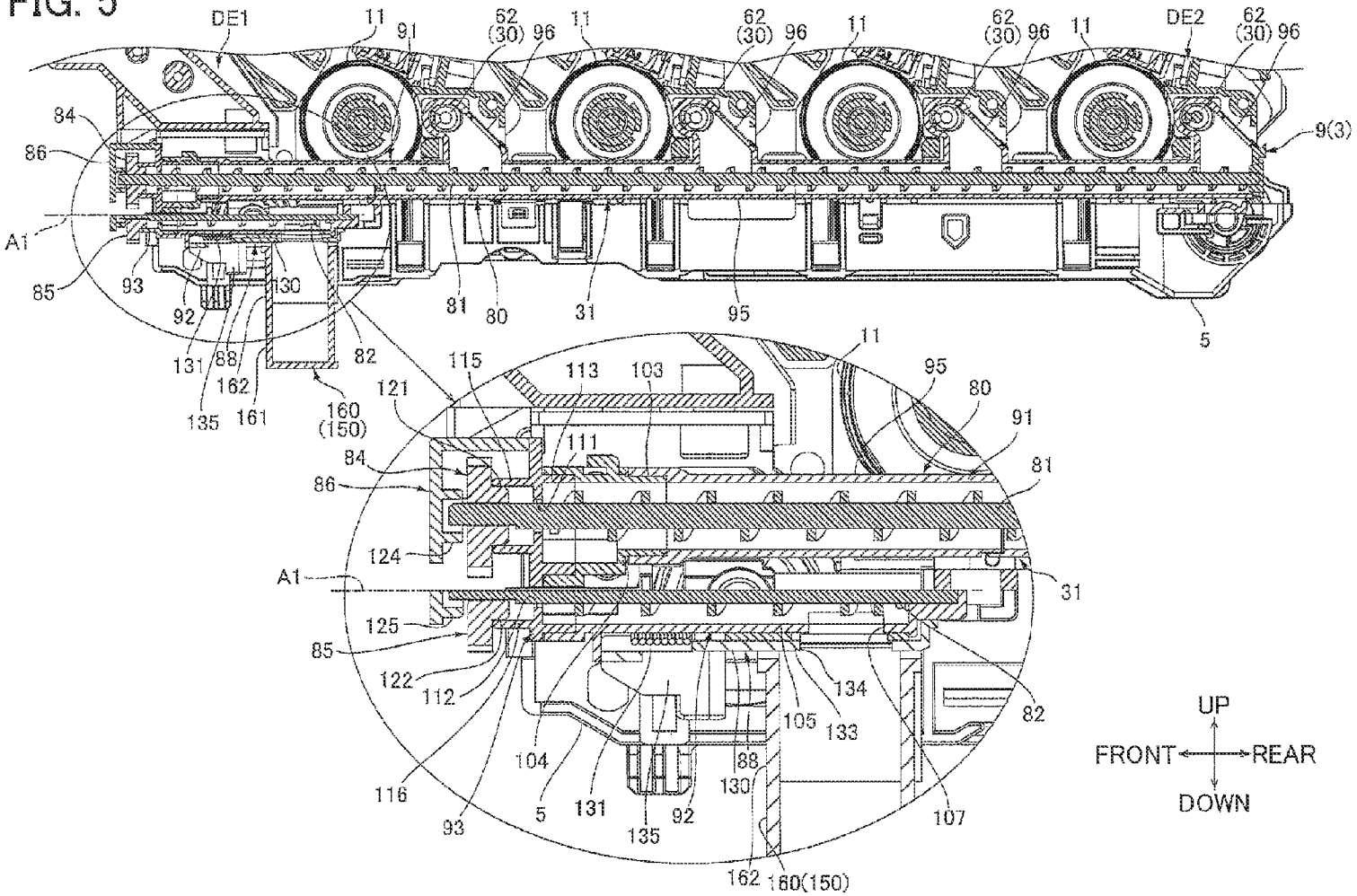
FIG. 5 is a cross-sectional view taken along a line A-A of FIG. 4.

As illustrated in FIGS. 2 and 4, the conveying unit 31 is positioned at a right lower end portion of the drum unit 9. The conveying unit 31 is adapted to convey toner removed from the surface of the photosensitive drum 11 by the cleaning unit 30 to a waste toner accommodation unit 150 described later. As illustrated in FIG. 5, the conveying unit 31 includes a conveying tube 80, a first conveying member 81, a second conveying member 82 as an example of a conveying member, a first conveying gear 84, a second conveying gear 85 as an example of a first gear, a gear cover 86, and a shutter unit 88.

The conveying tube 80 extends in the frontward/rearward direction, i.e., in a moving direction of the drum unit 9. The conveying tube 80 includes a first conveying portion 91, a second conveying portion 92, and a closed portion 93 formed with a through-hole 111 through which the first conveying member 81 extends and a through-hole 112 through which the second conveying member 82 extends.

The first conveying portion 91 includes a first conveying tube 95, and a plurality of (four) connecting portion 96.

The first conveying tube 95 extends in the frontward/rearward direction and is generally hollow cylindrical whose rear end portion is closed.

The four connecting portion 96 are spaced away from each other in the frontward/rearward direction and are positioned above the first conveying tube 95. Each connecting portion 96 is generally hollow cylindrical and is adapted to fluidly connect a right end portion of the frame 60 of corresponding cleaning unit 30 to an upper end portion of the first conveying tube 95, such that the connecting portion 96 provides communication between the corresponding frame 60 and the first conveying tube 95.

Although not illustrated in the drawings, the first conveying tube 95 is fixed to the frame 60 and the first positioning plate 28 such that the connecting portion 96 is nipped between the first positioning plate 28 and the right end portion of the frame 60 of the cleaning unit 30 and is threadingly engaged therewith by a thread member.

The second conveying portion 92 includes a joining portion 103, a second conveying tube 104, and a third conveying tube 105 formed with a discharge opening 107.

The joining portion 103 is positioned at a left upper end portion of the second conveying portion 92. The joining portion 103 extends in the frontward/rearward direction and is generally hollow cylindrical coaxial with the first conveying tube 95. The joining portion 103 is fitted with a front end portion of the first conveying tube 95.

The second conveying tube 104 is positioned at a right lower portion of a front end portion of the joining portion 103. The second conveying tube 104 diagonally extends such that its left end is positioned higher than its right end. The second conveying tube 104 is generally tubular rectangular column whose front end is open. The second conveying tube 104 has a left upper end portion in communication with a right lower portion of a front end portion of the joining portion 103. That is, the second conveying tube 104 is connected to the front end portion of the first conveying tube 95 through the joining portion 103.

The third conveying tube 105 extends rearward from a right lower end portion of the second conveying tube 104. The third conveying tube 105 is generally hollow cylindrical whose rear end is closed. That is, the third conveying tube 105 is communicated with the first conveying tube 95 through the second conveying tube 104. In other words, the second conveying tube 104 provides fluid communication between the first conveying tube 95 and the third conveying tube 105. As illustrated in FIG. 6A, the third conveying tube 105 is positioned downward of the first positioning plate 28. The third conveying tube 105 has a rear end portion positioned frontward of a central axis of the frontmost photosensitive drum 11, and frontward of the frontmost connecting portion 96.

The discharge opening 107 is formed at the rear end portion of the third conveying tube 105. More specifically, the discharge opening 107 extends vertically through a thickness of the bottom wall portion at the rear end portion of the third conveying tube 105. The discharge opening 107 has a generally rectangular shape in bottom view, and is positioned frontward of the central axis of the frontmost photosensitive drum 11.

Figure 3:
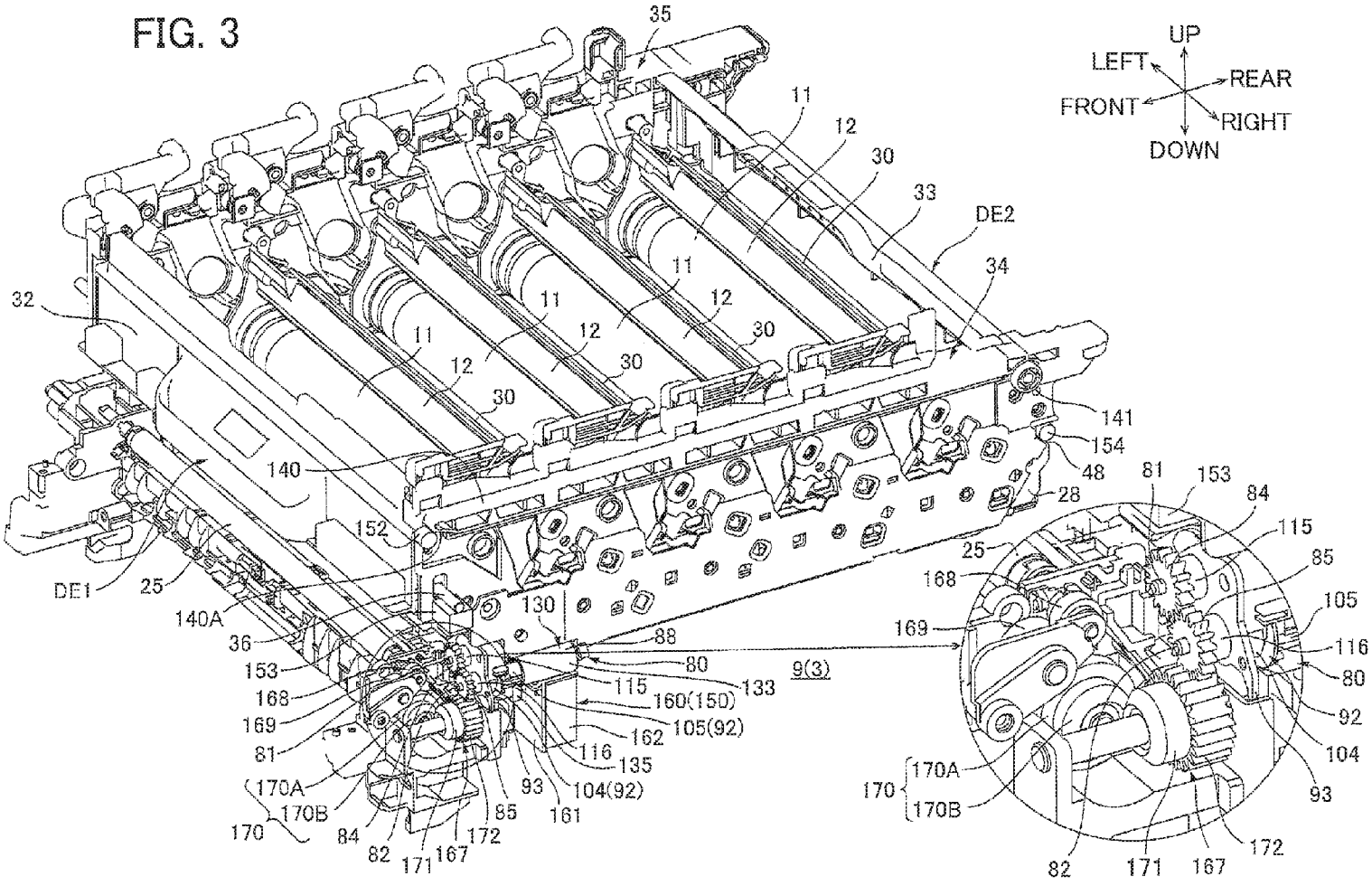
FIG. 3 is a perspective view of the drum unit positioned in a housing of the image forming apparatus according to the first embodiment.
Figure 6B:
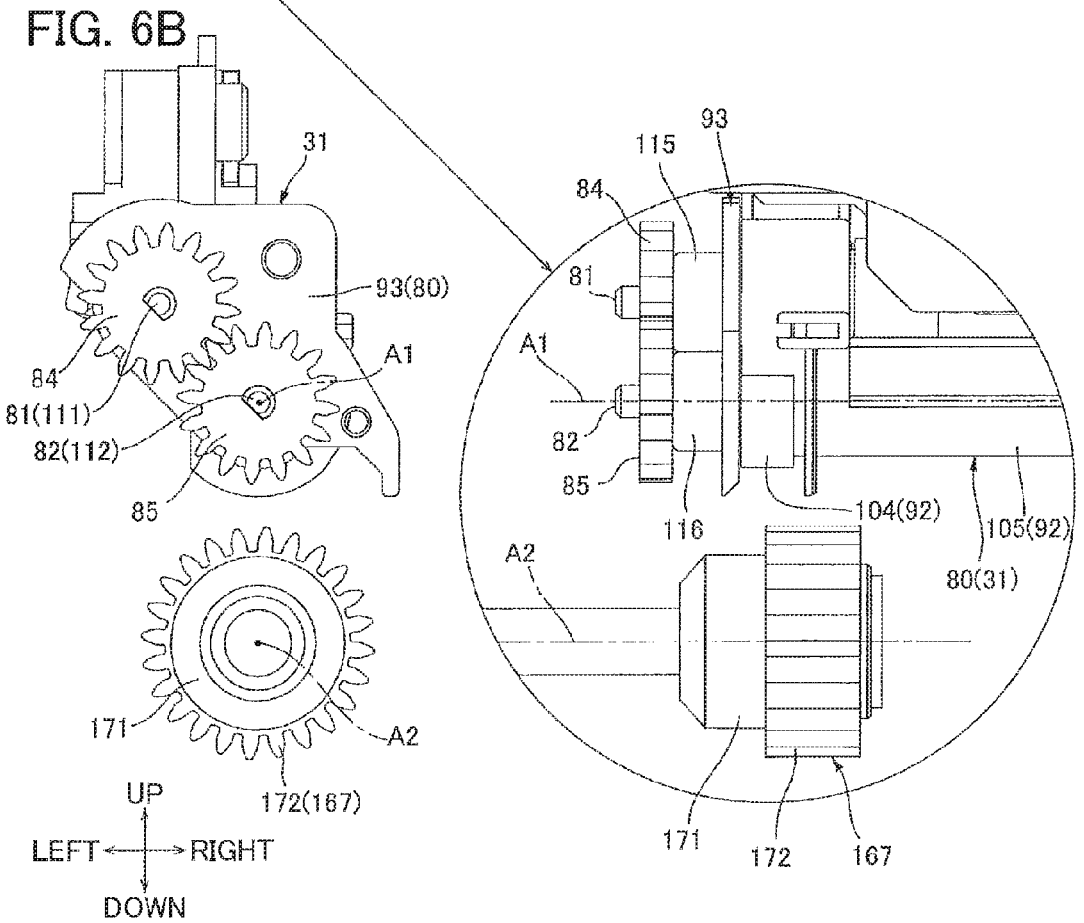
FIG. 6B is a front view illustrating positional relationship between a second conveyer gear and a transmission gear those illustrated in FIG. 6A.

As illustrated in FIGS. 3 and 5, the closed portion 93 is provided at a front end portion of the conveying tube 80. As illustrated in FIG. 6B, the closed portion 93 is generally rectangular flat plate shaped in front view, and diagonally extends such that its left end is positioned higher than its right end. As illustrated in FIGS. 5 and 6A, the closed portion 93 includes an insertion portion 113, a support portion 115 supporting the first conveying gear 84, and a support portion 116 supporting the second conveying gear 85.

As illustrated in FIGS. 5 and 6B, the through-hole 111 is positioned at a center region of a left upper portion of the closed portion 93, and is circular in front view. The through-hole 111 is coaxial with the first conveying member 81.

The through-hole 112 is positioned at a center region of a right lower portion of the closed portion 93, and is circular in front view. The through-hole 112 is coaxial with the second conveying member 82.

The insertion portion 113 extends rearward from a rear surface of the closed portion 93. Although not illustrated, the insertion portion 113 is hollow elliptical in cross-section, and is fitted with a front end portion of the second conveying portion 92.

The support portion 115 extends frontward from a front surface of the closed portion 93 and at a position slightly away from a peripheral surface of the through-hole 111. The support portion 115 is generally hollow cylindrical, and is coaxial with the through-hole 111.

The support portion 116 extends frontward from the front surface of the closed portion 93 and at a position slightly away from a peripheral surface of the through-hole 112. The support portion 116 is generally hollow cylindrical, and is coaxial with the through-hole 112.

The first conveying member 81 is positioned in the first conveying tube 95 of the first conveying portion 91. The first conveying member 81 is an auger in the form of a right-handed screw rotatable about an axis extending in the frontward/rearward direction. The first conveying member 81 has a rear end portion rotatably supported to a rear wall of the first conveying tube 80. The first conveying member 81 has a front end portion extending through the through-hole 111 of the closed portion 93 so that a front end of the first conveying member 81 is positioned frontward of a front end of the support portion 115 of the closed portion 93.

The second conveying member 82 is positioned in the third conveying tube 105 of the second conveying portion 92. The second conveying member 82 is an auger in the form of a right-handed screw rotatable about an axis A1 extending in the frontward/rearward direction. The second conveying member 82 is positioned rightward and downward of the first conveying member 81, and extends in parallel to the first conveying member 81. The second conveying member 82 has a length in the frontward/rearward direction smaller than that of the first conveying member 81. The second conveying member 82 has a rear end portion rotatably supported to a rear wall of the third conveying tube 105. The second conveying member 82 has a front end portion extending through the through-hole 112 of the closed portion 93 so that the front end of the second conveying member 82 is positioned frontward of a front end of the support portion 116 of the closed portion 93.

As illustrated in FIGS. 5 and 6A, the first conveying gear 84 is positioned frontward of the closed portion 93 and is supported to the front end portion of the first conveying member 81 avoiding relative rotation therebetween. The first conveying gear 84 is generally cylindrical extending in the frontward/rearward direction. Gear teeth are formed on an entire peripheral surface of the first conveying gear 84. That is, the first conveying gear 84 is fixed to the first conveying member 81 and is rotatable along with the first conveying member 81. As illustrated in FIG. 5, the first conveying gear 84 is provided with a first boss 121.

The first boss 121 protrudes rearward from a rear surface of the first conveying gear 84, and is generally cylindrical coaxial with the first conveying gear 84. The first boss 121 is rotatably supported to the support portion 115 of the closed portion 93.

As illustrated in FIGS. 5 and 6A, the second conveying gear 85 is positioned frontward of the closed portion 93 and is supported to the front end portion of the second conveying member 82 avoiding relative rotation therebetween. The second conveying gear 85 is generally cylindrical extending in the frontward/rearward direction. Gear teeth are formed on an entire peripheral surface of the second conveying gear 85. That is, the second conveying gear 85 is fixed to the second conveying member 82 and is rotatable along with the second conveying member 82. The second conveying gear 85 has a left upper portion meshedly engaged with a right lower portion of the first conveying gear 84. Further, as illustrated in FIG. 5, the second conveying gear 85 is provided with a second boss 122.

The second boss 122 protrudes rearward from a rear surface of the second conveying gear 85, and is generally cylindrical coaxial with the second conveying gear 85. The second boss 122 is rotatably supported to the support portion 116 of the closed portion 93.

As illustrated in FIGS. 4 and 5, the gear cover 86 is provided at a front end portion of the conveying unit 31. The gear cover 86 is generally box-shaped whose rear side and left lower side are open. The gear cover 86 partially covers the first conveying gear 84 and second conveying gear 85 from front side such that a left lower portion of the first conveying gear 84 and a left lower portion of the second conveying gear 85 are exposed to an outside. The gear cover 86 includes a protruding portion 123 (FIG. 4), a support portion 124 supporting the first conveying member 81, and a support portion 125 supporting the second conveying member 82.

As illustrated in FIGS. 2 and 4, the protruding portion 123 is provided at a right lower portion of the gear cover 86. The gear cover 86 is provided with a generally flat plate portion having a generally rectangular shape in side view and extending downward from a right wall of the protruding portion 123.

As illustrated in FIG. 5, the support portion 124 protrudes rearward from a rear surface of a front wall of the gear cover 86, and is generally hollow cylindrical. The support portion 124 is coaxial with the first conveying member 81, and receives a front end portion of the first conveying member 81 allowing relative rotation therebetween.

The support portion 125 is positioned rightward and downward of the support portion 124, and protrudes rearward from the rear surface of the gear cover 86, and is generally hollow cylindrical. The support portion 125 is coaxial with the second conveying member 82, and receives a front end portion of the second conveying member 82 allowing relative rotation therebetween.

As illustrated in FIG. 2, the shutter unit 88 is assembled to the third conveying tube 105 of the second conveying portion 92. The shutter unit 88 includes a shutter 130, and an urging member 131.

The shutter 130 is pivotally movable between a closed position illustrated in FIG. 2 in which the shutter 130 closes the discharge opening 107 of the third conveying tube 105 and an open position illustrated in FIG. 5 in which the shutter 130 opens the discharge opening 107. Incidentally, the following description with respect to the shutter 130 is based on the closed position illustrated in FIG. 2 as a reference position.

The shutter 130 includes a shutter body 133 formed with a communication opening 134, and a projecting portion 135.

The shutter body 133 extends in the frontward/rearward direction and is generally cylindrical. The shutter body 133 receives therein the third conveying tube 105.

The communication opening 134 extends in the leftward/rightward direction through a thickness of a right side peripheral wall of the shutter body 133, and is generally rectangular in shape in side view. The communication opening 134 is approximately aligned with the discharge opening 107 of the third conveying tube 105 in the frontward/rearward direction.

The projecting portion 135 protrudes rightward from a right front end portion of the shutter body 133, and is generally flat plate and L-shaped in side view. The projecting portion 135 has a front end portion positioned frontward of a front end portion of the shutter body 133. The projecting portion 135 is oriented downward from the shutter body 133 when the shutter 130 is positioned at its open position illustrated in FIG. 5, and is oriented rightward from the shutter body 133 when the shutter 130 is at its closed position illustrated in FIG. 2.

As illustrated in FIGS. 2 and 5, the urging member 131 is a coil spring extending in the frontward/rearward direction. The urging member 131 receives therein a front end portion of the third conveying tube 105. The urging member 131 is positioned to align with the projecting portion 135 of the shutter 130 in the frontward/rearward direction. Although not illustrated in the drawings, one end portion of the coil spring is fixed to the third conveying tube 105, and another end portion of the coil spring is fixed to the projecting portion 135, so as to urge the projecting portion 135 in the counterclockwise direction in front view so that the projecting portion 135 is normally oriented rightward to provide the closed position of the shutter 130.

(4) Front Plate, Rear Plate, First Side Plate, Second Side Plate and Unit Reference Shaft As illustrated in FIG. 2, the front plate 32 constitutes a front end portion of the drum unit 9. The front plate 32 is elongated in the leftward/rightward direction and is generally flat rectangular plate shaped. The front plate 32 is spanned between a front end portion of the first positioning plate 28 and a front end portion of the second positioning plate 29.

The rear plate 33 constitutes a rear end portion of the drum unit 9. The rear plate 33 is elongated in the leftward/rightward direction and is generally flat rectangular plate shaped. The rear plate 33 is bridged between a rear end portion of the first positioning plate 28 and a rear end portion of the second positioning plate 29.

As illustrated in FIGS. 2, 4, and 6A, the first side plate 34 is positioned rightward of the first positioning plate 28. The first side plate 34 is generally rectangular plate shaped in side view and has a width in the vertical direction greater than that of the first positioning plate 28. The first side plate 34 is provided with a rail 140 and a roller 141.

The rail 140 is provided at an upper end portion of the first side plate 34. The rail 140 protrudes rightward from a right surface of the first side plate 34, and extends along a length of the first side plate 34 in the frontward/rearward direction. The rail 140 has prismatic columnar shape. The rail 140 has a front lower end portion found into a slant surface 140A whose surface is inclined upward toward front. Incidentally, an angle between the slant surface 140A and the frontward/rearward direction ranges from 10 to conveying tube 80 degrees, preferably 20 to 70 degrees, and more preferably 30 to 50 degrees.

The roller 141 is positioned at a rear upper end portion of the first side plate 34, and rearward of the rail 140. The roller 141 is rotatable about an axis extending in the leftward/rightward direction. Incidentally, a right end of the roller 141 is positioned rightward of a right end of the rail 140 as illustrated in FIG. 4, and a lower end of the roller 141 is positioned lower than a lower end of the rail 140 as illustrated in FIG. 6A.

As illustrated in FIG. 4, the second side plate 35 is positioned leftward of the second positioning plate 29. The second side plate 35 is generally rectangular plate shaped in side view and has a width in the vertical direction greater than that of the second positioning plate 29. As illustrated in FIG. 4, similar to the first side plate 34, the second side plate 35 is provided with a rail 140 and roller 141. The rail 140 and the roller 141 of the second side plate 35 and the rail 140 and the roller 141 of the first side plate 34 are bilaterally symmetric with each other with respect to a center of the housing 2 in front view. Therefore, further description will be omitted.

As illustrated in FIGS. 2 and 4, the unit reference shaft 36 is positioned at a front end portion of the drum unit 9. The unit reference shaft 36 is made from metal and extends in the leftward/rightward direction, and has a generally cylindrical shape. As illustrated in FIG. 6A, the unit reference shaft 36 extends through the hole 44 of the first positioning plate 28 and the second positioning plate 29. As illustrated in FIGS. 2 and 4, the unit reference shaft 36 has a right end portion protruding rightward with respect to the first side plate 34, and a left end portion protruding leftward with respect to the second side plate 35.

Incidentally, the front end portion of the drum unit 9, that is, an upstream end of the drum unit 9 in a direction from the first position to the second position will be referred to as "first end portion DE1", and the rear end portion of the drum unit 9, that is, an end opposite to the upstream end will be referred to as "second end portion "DE2".

2. Structure of Housing

As illustrated in FIGS. 3 and 6A, the housing 2 includes a waste toner accommodation unit 150, a guide portion 151, a guide protrusion 152, a mounting portion 153, a positioning portion 154, and a power transmission unit 167.

As illustrated in FIG. 1, the waste toner accommodation unit 150 is positioned downward of the belt unit 5. The waste toner accommodation unit 150 is generally box shaped and is adapted to accumulate toner removed by the cleaning unit 30. As illustrated in FIGS. 4 and 5, the waste toner accommodation unit 150 is provided with an inlet tube 160.

The inlet tube 160 is positioned at a right end portion of a front end portion of the waste toner accommodation unit 150, and includes a first portion 161 and a second portion 162.

The first portion 161 is tubular having polygonal shape in cross-section and extends in the leftward/rightward direction. Although not illustrated, the first portion 161 has a left end portion in communication with an interior of the waste toner accommodation unit 150.

The second portion 162 is positioned at rightward of the front end portion of the belt unit 5, and is tubular having polygonal shape in cross-section extending in the vertical direction. The second portion 162 has a lower end portion in communication with the first portion 161.

As illustrated in FIG. 6A, the guide portion 151 is positioned at generally center portion of the housing 2 in the vertical direction. The housing 2 has a left wall and a right wall, and one guide portion 150 protrudes inward from an inner surface of the left wall in the leftward/rightward direction, and another guide portion 150 protrudes inward from an inner surface of the right wall in the leftward/rightward direction. The guide portion 151 includes a horizontal portion 151A, an inclined portion 151B, and a receiving portion 151C.

The horizontal portion 151A is generally linear in shape extending in the frontward/rearward direction.

The inclined portion 151B is continuous with a rear end of the horizontal portion 151A and diagonally extends downward with a distance from the rear end. An angle between the inclined portion 151B and the frontward/rearward direction ranges from 10 to 80 degrees, preferably 20 to 70 degrees and more preferably 30 to 50 degrees. The receiving portion 151C is continuous with a rear end of the inclined portion 151B and is recessed downward.

As illustrated in FIGS. 3 and 6A, the guide protrusion 152 is generally cylindrical and is positioned at generally center portion of the front end portion of the housing 2 in the vertical direction. One guide protrusion 152 protrudes inward from the inner surface of the left wall of the housing 2 in the leftward/rightward direction, and another guide protrusion 152 protrudes inward from the inner surface of the right wall of the housing 2 in the leftward/rightward direction. The guide protrusion 152 is positioned higher than the guide portion 151. A vertical distance between an upper end of the guide protrusion 152 and the horizontal portion 151A of the guide portion 151 is approximately the same as a vertical distance between a lower end of the roller 141 and a lower end of the rail 140 provided at the first side plate 34 of the drum unit 9.

The mounting portion 153 is positioned downward of the guide protrusion 152 and is generally prismatic in shape. One mounting portion 153 protrudes inward from the inner surface of the left wall of the housing 2 in the leftward/rightward direction, and another mounting portion 153 protrudes inward from the inner surface of the right wall of the housing 2 in the leftward/rightward direction.

The positioning portion 154 is positioned rearward and downward of the receiving portion 151C of the guide portion 151. The positioning portion 154 is made from metal and is generally cylindrical extending in the leftward/rightward direction. The positioning portion 154 is spanned between the left wall and the right wall of the housing 2.

As illustrated in FIG. 3, the power transmission unit 167 is positioned downward of the mounting portion 153, and includes the second registration roller 25, a registration gear 168, a first idle gear 169, a second idle gear 170, a third idle gear 171, and a transmission gear 172 as an example of a second gear.

The second registration roller 25 is generally cylindrical and extends in the leftward/rightward direction. The second registration roller 25 is adapted to be rotated upon receipt of driving force from an external drive source (not illustrated).

The registration gear 168 is supported to a right end portion of the second registration roller 25 such that relative rotation between the registration gear 168 and the second registration roller 25 is prevented. The registration gear 168 is generally cylindrical and extends in the leftward/rightward direction. Gear teeth are formed over an entire peripheral surface of the registration gear 168.

The first idle gear 169 is positioned frontward and downward of the registration gear 168. The first idle gear 169 is generally cylindrical and extends in the leftward/rightward direction. Gear teeth are formed over an entire peripheral surface of the first idle gear 169. The first idle gear 169 has a rear upper end portion in meshing engagement with a front lower end portion of the registration gear 168.

The second idle gear 170 is positioned frontward and downward of the first idle gear 169, and includes a large diameter gear portion 170A and a small diameter gear portion 170B.

The large diameter gear portion 170A is generally cylindrical and extends in the leftward/rightward direction. Gear teeth are formed over an entire peripheral surface of the large diameter gear portion 170A. The large diameter gear portion 170A has a front upper end portion in meshing engagement with a rear lower end portion of the first idle gear 169.

The small diameter gear portion 170B is coaxial with the large diameter gear portion 170A and is generally cylindrical. The small diameter gear portion 170B is a bevel gear.

The third idle gear 171 is positioned frontward and rightward of the second idle gear 170. As illustrated in FIGS. 3 and 6A, the third idle gear 171 is generally cylindrical extending in the frontward/rearward direction. The third idle gear 171 is a bevel gear, and has a left front end portion in meshing engagement with a right rear end portion of the small diameter gear portion 170B.

The transmission gear 172 is coaxial with the third idle gear 171, and is generally cylindrical. The transmission gear 172 is rotatable about a second axis A2 extending in the frontward/rearward direction. The transmission gear 172 is coupled to the third idle gear 171 so that relative rotation therebetween is prevented. The transmission gear 172 has a length in the frontward/rearward direction greater than that of the second conveying gear 85.

4. Attachment/Detachment Operation of Drum Unit

To perform attachment of the drum unit 9 to housing 2, the user first opens the front cover 22 by pivotally moving the front cover 22 about the lower end thereof operating as a fulcrum, thereby bringing the opening 21 to be exposed, as shown in FIG. 1.

As shown in FIGS. 1 and 2, the user lifts and holds the drum unit 9 and places the latter in the first position, and then moves the drum unit 9 rearward through the opening 21.

More specifically, when the drum unit 9 moves rearward inside the housing 2, the roller 141 moves along the horizontal portion 151A of the guide portion 151 formed in the housing 2 while the lower surface of the rail 140 and the upper portion of the guide protrusion 152 being held in contact with each other, as shown in FIG. 6A.

With such rearward movements of the drum unit 9, the latter is brought into the second position where the slant surface 140A of the rail 140 formed in the drum unit 9 is in contact with the guide protrusion 152 of the housing 2 at a frontward position of the rail 140 with the slant surface 140A being in an upper position relative to the rail 140.

Further, in the second position, the roller 141 provided in drum unit 9 is positioned above the rear portion of the horizontal portion 151A of the guide portion 151 and held in contact therewith.

As shown in FIGS. 6A and 6B, the second conveying gear 85 included in the conveying unit 31 of the drum unit 9 is in a front upper position with respect to the transmission gear 172 included in the registration gear 168 of the housing 2.

After the drum unit 9 has reached the second position, the user closes the front cover 22 by pivotally moving the front cover 22 from the open position to the closed position.

Figure 7A:
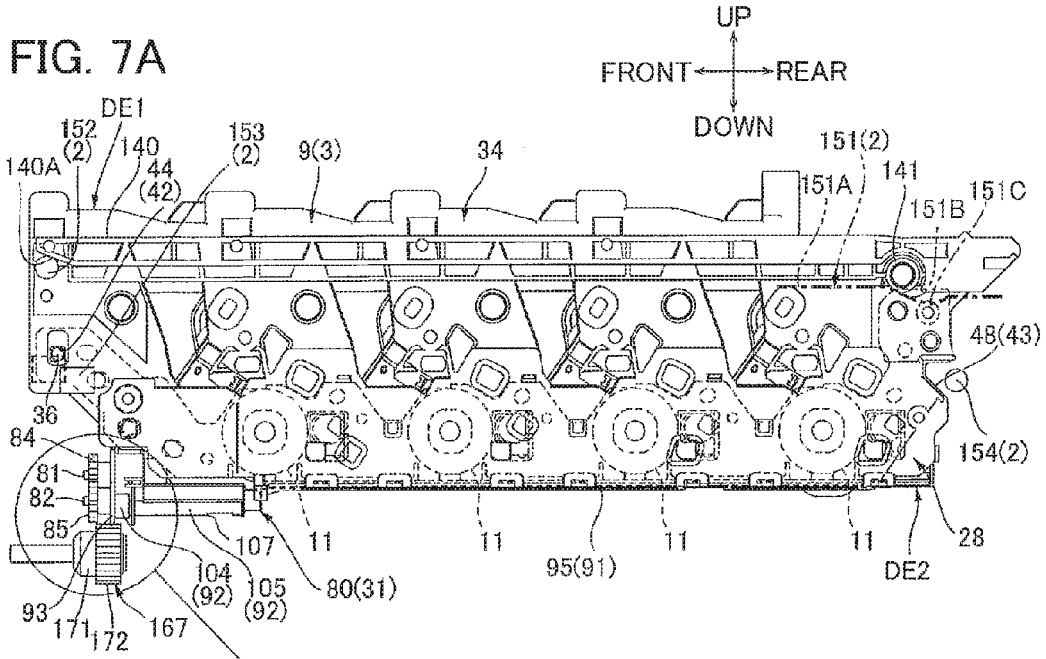
FIG. 7A is a view for description of attachment and detachment of the drum unit to and from the housing and showing a state where the drum unit is positioned between the second position and a third position in the image forming apparatus according to the first embodiment.

As shown in FIG. 7A, the drum unit 9 further moves rearward in an interlocking relation with the movements of the housing 2 moving toward the closed position by virtue of a well-known interlocking mechanism.

The slant surface 140A of the rail 140 provided in the drum unit 9 is brought into contact with the guide protrusion 152 formed in the housing 2 with the slant surface 140A being positioned above the guide protrusion 152.

Through the attachment procedure of the drum unit 9 to the housing 2, the roller 141 of the drum unit 9 is guided toward the inclined portion 151B along the 151A of the guide portion 151. In the final stage of the attachment, the roller 141 is positioned above the inclined portion 151B and brought into contact therewith.

From this position, the drum unit 9 is further moved in the front/lower direction while being guided by the guide protrusion 152 and the inclined portion 151B of the guide portion 151.

Figure 7B:
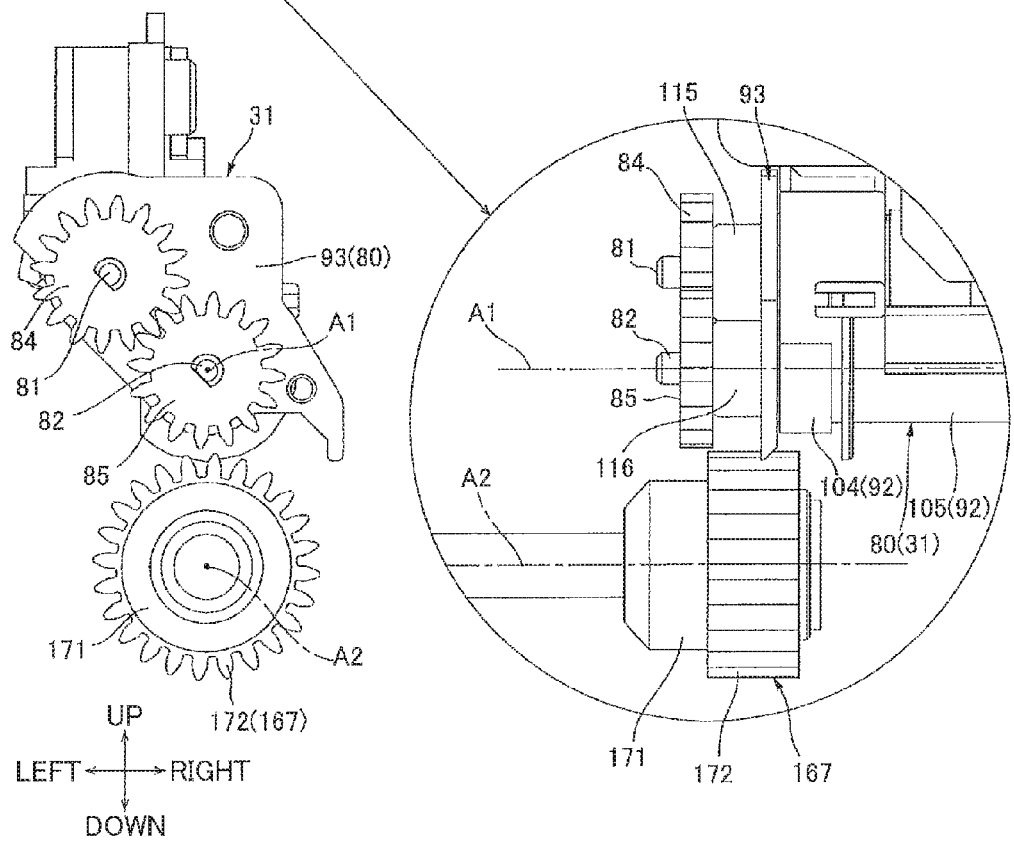
FIG. 7B is a front view illustrating positional relationship between the second conveyer gear and the transmission gear those illustrated in FIG. 7A.

As shown in FIG. 7B, the second conveying gear 85 is brought into alignment with the transmission gear 172 in the vertical direction and these two gears are brought into meshing engagement with each other during the movements of the drum unit 9 from the second position to the third position.

On the way of movements of the drum unit 9, the projecting portion 135 of the shutter 130 is brought into abutment with the abutment portion (not shown) of the housing 2, causing the shutter 130 to start rotating clockwise as viewed from front.

When the user moves the front cover 22 to the closed position, the drum unit 9 is pushed to further move rearward into the housing 2 as shown in FIG. 8A, whereupon the rail 140 of the drum unit 9 is brought into contact with the guide protrusion 152 in such a way that the upper portion of the slant surface 140A first contacts the upper portion of the guide protrusion 152.

The roller 141 of the drum unit 9 is guided by the inclined portion 151B of the guide portion 151 to move toward the receiving portion 151C and is finally received at the receiving portion 151C. In this way, the drum unit 9 is moved rearward and diagonally downward. Upon receipt of the drum unit 9 at the receiving portion 151C, the discharge tray 8 moves downward toward the transmission gear 172 to meshingly engage therewith. At this time, the first axis A1 is positioned above the second axis.

Further, the notched portion 48 formed in the first positioning plate is brought into engagement with the right end of the positioning portion 154. Although not appeared in the drawings, the notched portion 48 formed in the second positioning plate is brought into engagement with left end of the positioning portion 154. Due to such engagements, further rearward movements of the drum unit 9 is regulated, and the vertical movements of the second end formed in the drum unit 9 is also regulated.

Further, the unit reference shaft 36 of the drum unit 9 is disposed on the upper surface of the mounting portion 153 in the housing 2, thereby regulating the downward movements of the first end in the drum unit 9. With the above-described operations, positioning of the drum unit 9 at the third position is accomplished.

By the abutment of the abutting portion (not shown) provided in the housing 2 with the projecting portion 135, the projecting portion 135 extends downward and the shutter body 133 rotates clockwise as viewed from front. As shown in FIG. 5, the communication opening 134 is positioned below the shutter body 133 and the shutter 130 is brought to an open position where the shutter 130 is vertically in communication with the discharge opening 107 of the third conveying tube 105.

Figure 9:
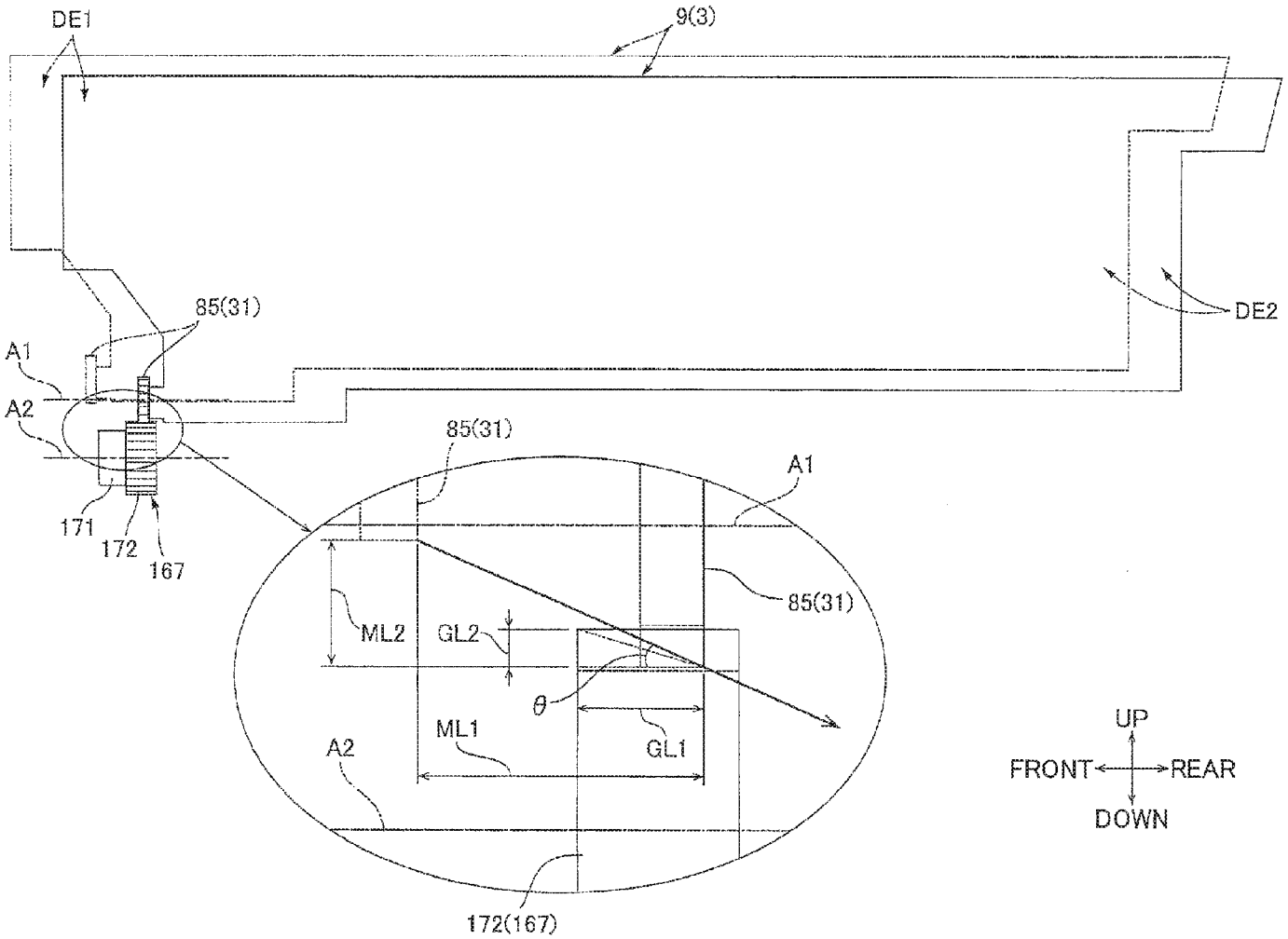
FIG. 9 is a schematic view for description of the attachment and detachment of the drum unit to and from the housing in the image forming apparatus according to the first embodiment.

As shown in FIG. 9, under the condition that drum unit 9 is in the third position, the length in the front/rear direction between the rear lower end portion of the second conveying gear 85 to the front upper end portion of the transmission gear 172 will be referred to as "frontward/rearward meshing engagement length GL1", and the length in the vertical direction from the rear lower end portion of the second conveying gear 85 to the front upper end portion of the transmission gear 172 will be referred to as "vertical meshing length GL2". Also, an angle formed by the horizontal direction and the direction from the second to the third position of the drum unit 9 will be referred to as "moving angle θ"

With the above definitions, frontward/rearward meshing engagement length GL1, GL2, and moving angle θ satisfy the following inequality (1).

$$\theta > \arctan(GL2/GL1) \quad (1)$$

The above inequality indicates that the moving angle θ is greater than the angle formed by frontward/rearward meshing engagement length GL1 and vertical meshing engagement length GL2. Note that the moving angle θ is equal to the angle formed by the slant surface 140A and the front/rear direction as well as the angle formed by the inclined portion 151B and the front/rear direction. Consequently, the second conveying gear 85 and the transmission gear 172 can be brought into meshing engagement with each other in the vertical direction prior to engagement of the two in the front/rear direction when the drum unit 9 is moved from the second to the third position.

The moving distance of the drum unit 9 in the frontward/rearward direction from the second to the third position will be referred to as "frontward/rearward movement distance ML1", and the movement distance of the drum unit 9 in the vertical direction from the second to the third position will be referred to as "vertical movement distance ML2". Note that the frontward/rearward movement distance ML1 is longer than frontward/rearward meshing engagement length GL1. With the above definitions, frontward/rearward meshing engagement length GL1, vertical meshing engagement length GL2, frontward/rearward movement distance ML1, and vertical movement distance ML2 satisfy the following inequality (2).

$$ML2/ML1 > GL2/GL1 \quad (2)$$

The above inequality indicates that the ratio of vertical movement distance to frontward/rearward movement distance ML1 is greater than the ratio of vertical meshing engagement length GL2 to frontward/rearward meshing engagement length GL1. Consequently, the second conveying gear 85 and the transmission gear 172 can be brought into meshing engagement with each other in the vertical direction prior to engagement of the two in the front/rear direction when the drum unit 9 is moved from the second to the third position. In order to move the drum unit 9 from the third to the first position, the user has to operate the drum unit 9 in an order reverse to the above-described sequence. More specifically, the user first moves the front cover 22 of the housing 2 to the open position. As shown in FIG. 7A, in interlocking relation with the opening movement of the front cover 22, the drum unit 9 is pulled frontward by the conventionally known interlocking mechanism. At this time, the drum unit 9 moves frontward/upward, as the slant surface 140A gets on along the inclined portion 151B of the 1guide portion 151.

By the movements described above, the second conveying gear 85 moves frontward/upward with respect to transmission gear 172, resulting in meshing-disengagement of the second conveying gear 85 from the transmission gear 172. Upon positioning the front cover 22 to the open position, as shown in FIG. 6A, the drum unit 9 is brought to the second position. Then, the user grasps the drum unit 9 and pulls the same frontward. In this way, the drum unit 9 is brought to the first position. This completes the puling operation of the drum unit 9.

Upon removal of the drum unit 9 from the housing 2, the drum unit 9 is placed on a horizontal plane. In this state, the rear end portion of the first conveying tube 95 is placed to contact the horizontal plane in the rear end portion of the drum unit 9. And, the protruding portion 123 of the gear cover 86 is placed to contact the horizontal plane in the front end portion of the drum unit 9. This prevents the third conveying tube 105, first conveying gear, and second conveying gear 85 from contacting the horizontal plane.

5. Cleaning Operation

Next, description will be made with respect to the cleaning operation of the residual toner adhered to the surface of the photosensitive drum 11.

As shown in FIG. 1, the toner remains on the photosensitive drum 11 through the image forming operation. The residual toner is scraped off by the blade 61 of the cleaning unit 30 as the photosensitive drum 11 rotates. The blade 61 is disposed to contact the surface of the photosensitive drum 11. The toner scraped off from the surface of the photosensitive drum 11 drops within the frame 60. At this time, the conveying member 62 rotates clockwise as viewed from the right side by virtue of a gear (not shown) receiving driving power from the photosensitive drum 11.

The toner within the frame 60 is conveyed rightward by the conveying member 62. The toner conveyed rightward within the frame 60 enters into the first conveying tube 95 through the connecting portion 96, as shown in FIG. 5. As shown in FIG. 3, the second conveying member 82 rotates counterclockwise as viewed from front by the driving power transmitted through the transmission gear 172 of the power transmission unit 167 accommodated in the housing 2. The first conveying member 81 rotates clockwise as viewed from front by the driving power transmitted from the driving gear (not shown) of the housing 2 to the first conveying gear 84 through the second conveying gear 85. As a result, as shown in FIG. 5, the toner entered into the first conveying tube 95 is conveyed frontward by the first conveying member 81. In this way, the residual toner scrapped off from the surfaces of four photosensitive drums 11 is collected in block and conveyed frontward from the backside within the first conveying tube 95. The toner reached to the front end portion of the first conveying tube 95 enters into the joining tube 103 of the second conveying portion 92.

At this time, the toner being conveyed frontward by the first conveying member 81 is brought into impingement against the rear surface of the closed portion 93. The toner moves rightward/downward within the second conveying tube 104 due to the weight of the toner. Then, the toner enters into the front end portion of the third conveying tube 105.

The toner having entered into the front end portion of the third conveying tube 105 is further conveyed rearward by virtue of the second conveying member 82. The toner is conveyed to the discharge opening 107 while moving within the third conveying tube 105 and discharged into the inlet tube 160 through the discharge opening 107. The toner is then stored in the waste toner accommodating unit 150 through the inlet tube 160. As described above, the cleaning operation of the toner remaining on the surface of the photosensitive drum 11 is complete.

6. Function and Effect (1) According to the image forming apparatus 1 described above, the second conveying gear 85 fixed to the second conveying member 82 is rotatable about the first axis A1 extending in the frontward/rearward direction, and the transmission gear 172 provided at the housing 2 is rotatable about the second axis A2 extending in the frontward/rearward direction as illustrated in FIG. 6A. That is, the second conveying gear 85 and transmission gear 172 are rotatable about the axes extending in the frontward/rearward direction.

The drum unit 9 is moved from the first position outside of the housing 2 to the third position through the second position such that the drum unit 9 is moved toward the third position downward with respect to the first direction as illustrated in FIGS. 6A and 8A.

Accordingly, the second conveying gear 85 can be stably brought into meshing engagement with the transmission gear 172 from the above such that the first axis A1 is positioned upward of the second axis A2 when the drum unit 9 is positioned at the third position.

Here, since the drum unit 9 is provided with the cleaning unit 30 and the second conveying member 82, driving force can be transmitted to the second conveying member 82 through the second conveying gear 85 and the transmission gear 172, so that residual toner on the surface of the photosensitive drum 11 can be removed and the toner can be conveyed to the predetermined position.

Further, the second conveying gear 85 is disengaged from the transmission gear 172 when the drum unit 9 is at the second position as illustrated in FIGS. 6A and 6B. Therefore, the drum unit 9 can be smoothly moved to the first position outside the housing 2.

(2) Further, according to the image forming apparatus 1, the drum unit 9 can be smoothly moved in the frontward/rearward direction between the first position outside the housing 2 and the second position inside the housing 2 as illustrated in FIGS. 1 and 6A.

(3) Assuming that the gear teeth of the second conveying gar 85 and the transmission gear 172 are partly overlapped with each other in the frontward/rearward direction prior to partial overlapping of the gear teeth of the second conveying gear 85 and transmission gear 172 in the vertical direction during movement of the drum unit 9 from the second position to the third position, the second conveying gear 85 and the transmission gear 172 are in abutment with each other in the frontward/rearward direction, and smooth meshing engagement between the second conveying gear 85 and transmission gear 172 may not be attainable.

On the other hand, in the image forming apparatus 1 according to the embodiment, as illustrated in FIGS. 7A and 7B, the gear teeth of the second conveying gear 85 and the transmission gear 172 are partly overlapped with each other in the vertical direction prior to partial overlapping of the gear teeth of the second conveying gear 85 and transmission gear 172 in the frontward/rearward direction during movement of the drum unit 9 from the second position to the third position. Therefore, the second conveying gear 85 can be smoothly brought into engagement with the transmission gear 172 from above.

(4) Further, in the image forming apparatus 1 according to the embodiment, as illustrated in FIGS. 8A and 9, the transmission gear 172 has the length in the frontward/rearward direction greater than that of the second conveying gear 85. Therefore, this length difference can absorb occurrence of unwanted displacement of the drum unit 9 in the frontward/rearward direction during movement of the drum unit 9 in the frontward/rearward direction. Accordingly, meshing engagement of the second conveying gear 85 with the transmission gear 172 from above can further be ensured.

(5) Further, in the image forming apparatus 1 according to the embodiment, as illustrated in FIGS. 7A and 8A, the drum unit 9 can be moved from the second position to the third position in interlocking relation to the movement of the front cover 22 from its open position to the closed position. Therefore, the drum unit 9 can surely be positioned at the third position when the front cover 22 is at the closed position.

(6) Further, in the image forming apparatus 1 according to the embodiment, accuracy in positioning of the drum unit 9 at the third position can be improved because the housing 2 is provided with the positioning portion 154 as illustrated in FIG. 8A. Further, mechanical interference of the second conveying gear 85 with the positioning portion 154 can be prevented when the drum unit 9 is moved between the first position and the second position and between the second position and the third position, because the drum unit 9 is positioned upstream of the positioning portion 154 in a direction from the first position to the second position while the drum unit 9 is at the third position.

(7) Further, the image forming apparatus 1 according to the embodiment is satisfied with the above-described inequality (1) with reference to FIG. 9. Therefore, the second conveying gear 85 can be stably in meshing engagement with the transmission gear 172 from above, while avoiding contact therebetween in the vertical direction during movement of the drum unit 9 from the second position to the third position.

(8) Further, the image forming apparatus 1 according to the embodiment is satisfied with the above-described inequality (2) with reference to FIG. 9. Therefore, the second conveying gear 85 can be stably in meshing engagement with the transmission gear 172 from above, while avoiding contact therebetween in the first direction during movement of the drum unit 9 from the second position to the third position.

(9) Further, in the image forming apparatus 1 according to the embodiment, the cleaning unit 30 is provided with the blade 61 as illustrated in FIG. 1. Therefore, toner remaining on the surface of the photosensitive drum 11 can be removed with certainty.

(10) Further, in the image forming apparatus 1 according to the embodiment the second conveying member 82 is the auger screw as illustrated in FIG. 5. Therefore, stable conveyance of the toner can be realized.

7. Second Embodiment

An image forming apparatus 1 according to a second embodiment will next be described with reference to FIG. 10, wherein like parts and components are designated by the same reference numerals as those illustrated in the first embodiment.

In the first embodiment, the frontward/rearward movement distance ML1 is greater than frontward/rearward meshing engagement length GL1 as illustrated in FIG. 9.

Figure 10:
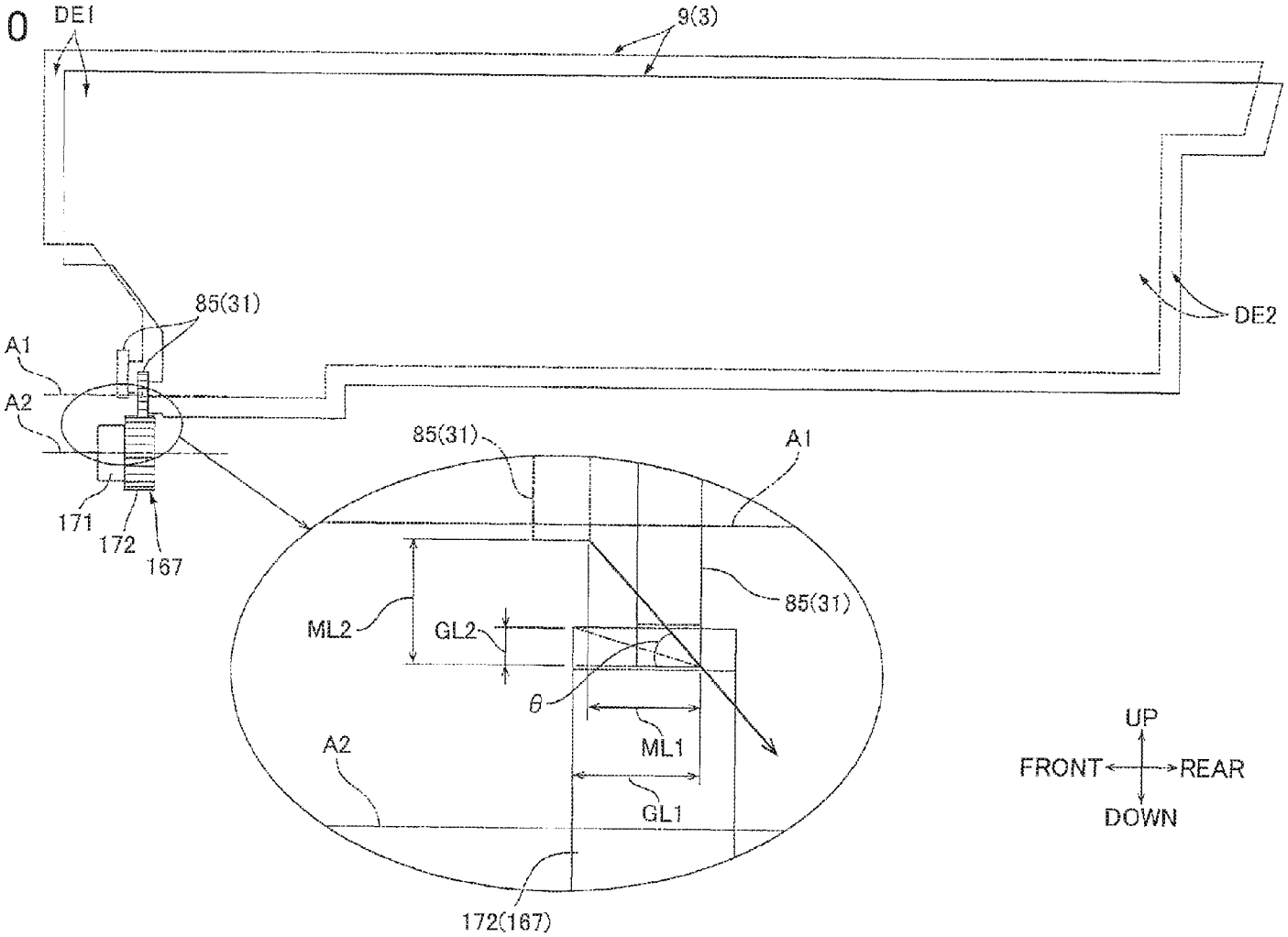
FIG. 10 is a schematic view for description of attachment and detachment of a drum unit to and from a housing in an image forming apparatus according to a second embodiment.

In contrast, according to the second embodiment, the frontward/rearward movement distance ML1 is smaller than the frontward/rearward meshing engagement length GL1 as illustrated in FIG. 10.

In this case, the relationship between the vertical meshing engagement length GL2 and the vertical movement distance ML2 is represented by the following inequality (3):

$$ML2>GL2 \quad (3)$$

That is, the second conveying gear 85 and the transmission gear 172 are vertically aligned with each other in a state where the drum unit 9 is at the second position.

Since the image forming apparatus 1 according to the second embodiment satisfies the inequality (3) as illustrated in FIG. 10, the second conveying gear 85 can be stably brought into engagement with the transmission gear 172 from above while restraining contact therebetween in the vertical direction during movement of the drum unit 9 from the second position to the third position.

Further, the image forming apparatus 1 according to the second embodiment can exhibit functions and effects the same as those of the image forming apparatus 1 according to the first embodiment.

8. Third Embodiment

An image forming apparatus 1 according to a third embodiment will next be described with reference to FIG. 11, wherein like parts and components are designated by the same reference numerals as those illustrated in the first embodiment.

According to the first embodiment, the drum unit 9 is moved between the second position and the third position along a diagonal locus connecting between a front upper side and a rear lower side as illustrated in FIGS. 6A and 8A.

Figure 11:
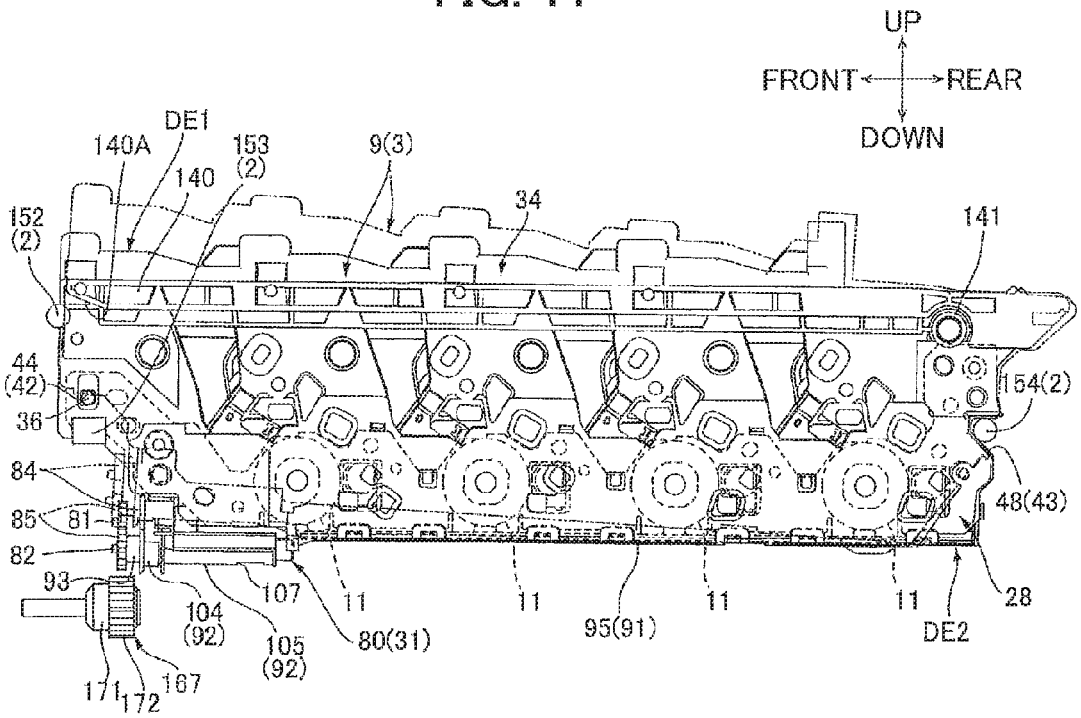
FIG. 11 is a schematic view for description of attachment and detachment of a drum unit to and from a housing in an image forming apparatus according to a third embodiment.

In contrast, according to the third embodiment, the drum unit 9 is pivotally movable about a positioning portion 154 of the housing 2 as a fulcrum as illustrated in FIG. 11. That is, the drum unit 9 is pivotally movable about the second end portion DE2 as a fulcrum between the second position and the third position.

In order to move the drum unit 9 from the third position to the second position, an operator moves the front cover 22 from its closed position to the open position while the drum unit 9 is at the third position.

As a result, the one end portion of the drum unit 9, i.e., the first end portion DE1 is lifted up by the conventional interlocking mechanism, and the drum unit 9 is pivotally moved in the clockwise direction in right side view about the rear end portion, i.e., the second end portion DE2 as a fulcrum.

Accordingly the second conveying gear 85 is moved upward away from the transmission gear 172, so that the second conveying gear 85 is disengaged from the transmission gear 172, and the drum unit 9 can be positioned at the second position.

Further, in order to move the drum unit 9 from the second position to the third position, an operator moves the front cover 22 from its open position to the closed position.

As a result, the first end portion DE1 of the drum unit 9 is pressed downward by the conventional interlocking mechanism, and the drum unit 9 is pivotally moved in the counterclockwise direction in right side view about the second end portion DE2 as the fulcrum.

Accordingly, the second conveying gear 85 approaches the transmission gear 172 from above, and is brought into meshing engagement with the transmission gear 172, and the drum unit 9 can be positioned at the third position.

In the image forming apparatus 1 according to the third embodiment, stabilized movement of the drum unit 9 between the second position and the third position can be obtained because of pivotal motion of the drum unit 9 about the second end portion DE2 as the fulcrum as illustrated in FIG. 11.

Further, the image forming apparatus 1 according to the third embodiment can exhibit functions and effects the same as those of the image forming apparatus 1 according to the foregoing embodiments.

While the technical features has been described in detail and with reference to specific embodiments thereof, it would be apparent for those skilled in the art that various changes and modifications may be made therein without departing from sprit and scope of the invention.

The invention claimed is:

1. An image forming apparatus comprising:

a housing;

a drum unit configured to move to a first position, a second position, and a third position, the drum unit being positioned outside the housing at the first position, the drum unit being configured to move in a first direction from the first position into the housing at the second position, and the drum unit being configured to move from the second position in a direction away from the first position to the third position at which the drum unit is inclined downward with respect to the first direction, the drum unit comprising:

a photosensitive drum having a surface;

a cleaning unit configured to remove residual toner deposited on the surface;

a conveying tube extending in the first direction and formed with a discharge opening through which the toner is discharged;

a conveying member disposed in the conveying tube and configured to be rotated about a first axis extending in the first direction; and a first gear fixed to the conveying member and configured to be rotated about the first axis; and a second gear provided at the housing and configured to be rotated about a second axis extending in the first direction, the first gear being disengaged from the second gear at the second position of the drum unit, and being engaged with the second gear at the third position of the drum unit, the first axis being positioned upward of the second axis in the third position.

2. The image forming apparatus according to claim 1, wherein the first direction is a horizontal direction.

3. The image forming apparatus according to claim 1, wherein the first gear and the second gear are configured to be aligned with each other in a vertical direction prior to alignment of the first gear with the second gear in the first direction during movement of the drum unit from the second position to the third position.

4. The image forming apparatus according to claim 1, wherein the second gear has a gear teeth thickness in the first direction greater than that of the first gear.

5. The image forming apparatus according to claim 1, wherein the housing is formed with an opening, the housing comprising a cover configured to be moved between an open position opening the opening and a closed position closing the opening; and wherein the drum unit is configured to be moved from the second position to the third position in interlocking relation to the movement of the cover from the open position to the closed position.

6. The image forming apparatus according to claim 1, wherein the drum unit has a first end portion at an upstream end of the drum unit in the first direction, and a second end portion opposite to the first end portion; and wherein the drum unit is pivotally moved about the second end portion during movement of the drum unit between the second position and the third position.

7. The image forming apparatus according to claim 1, wherein the housing is provided with a positioning portion to position the drum unit at the third position, the first gear being positioned upstream of the positioning portion in the first direction in a state where the drum unit is at the third position.

8. The image forming apparatus according to claim 1, wherein the drum unit, at the third position, has a first end portion at an upstream end of the drum unit in the first direction, and a second end portion opposite to the first end portion;

wherein an angle θ between the first direction and a direction from the second position to the third position is satisfied with the following inequality (1):

$$\theta > \arctan(GL2/GL1) \quad (1)$$

in which

GL1: a distance between one end of the first gear and a first end of the second gear in the first direction when the drum unit is at the third position, the one end of the first gear being closer to the second end portion than another end of the first gear to the second end portion in the first direction, and the first end of the second gear being closer to the first end portion than a second end of the second gear to the first end portion in the first direction; and GL2: a distance between a lowermost end of the first gear and an uppermost end of the second gear when the drum unit is at the third position.

9. The image forming apparatus according to claim 1, wherein the drum unit, at the third position, has a first end portion at an upstream end of the drum unit in the first direction, and a second end portion opposite to the first end portion;

wherein the following inequality (2) is satisfied:

$$ML2/ML1 > GL2/GL1 \quad (2)$$

provided that GL1 is smaller than ML1 in which

GL1: a distance between one end of the first gear and a first end of the second gear in the first direction when the drum unit is at the third position, the one end of the first gear being closer to the second end portion than another end of the first gear to the second end portion in the first direction, and the first end of the second gear being closer to the first end portion than a second end of the second gear to the first end portion in the first direction;

GL2: a distance between a lowermost end of the first gear and an uppermost end of the second gear when the drum unit is at the third position;

ML1: moving distance of the drum unit in the first direction when the drum unit is moved from the second position to the third position; and ML2: moving distance of the drum unit in the vertical direction when the drum unit is moved from the second position to the third position.

10. The image forming apparatus according to claim 1, wherein the drum unit, at the third position, has a first end portion at an upstream end of the drum unit in the first direction, and a second end portion opposite to the first end portion;

wherein the following inequality (3) is satisfied:

$$ML2 > GL2 \quad (3)$$

provided that GL1 is greater than or equal to ML1 in which

GL1: a distance between one end of the first gear and a first end of the second gear in the first direction when the drum unit is at the third position, the one end of the first gear being closer to the second end portion than another end of the first gear to the second end portion in the first direction, and the first end of the second gear being closer to the first end portion than a second end of the second gear to the first end portion in the first direction;

GL2: a distance between a lowermost end of the first gear and an uppermost end of the second gear when the drum unit is at the third position;

ML1: moving distance of the drum unit in the first direction when the drum unit is moved from the second position to the third position; and ML2: moving distance of the drum unit in the vertical direction when the drum unit is moved from the second position to the third position.

11. The image forming apparatus according to claim 1, wherein the cleaning unit comprises a blade.

12. The image forming apparatus according to claim 1, wherein the conveying member comprises an auger screw.

* * * * *